United States Patent [19]

Haley et al.

[11] Patent Number: 4,871,019

[45] Date of Patent: Oct. 3, 1989

[54] WELLBORE FLUID SAMPLING APPARATUS

[75] Inventors: Jerry L. Haley, Richardson; Weldon H. Barber, Wylie; Kavin J. Morris, Plano, all of Tex.

[73] Assignee: Atlantic Richfield Company, Los Angeles, Calif.

[21] Appl. No.: 241,535

[22] Filed: Sep. 7, 1988

[51] Int. Cl.[4] ..... E21B 34/06; E21B 49/08

[52] U.S. Cl. ..... 166/167; 166/332

[58] Field of Search ..... 166/162, 166, 167, 264, 166/332

[56] References Cited

U.S. PATENT DOCUMENTS

| | | | |
|---|---|---|---|
| 4,520,994 | 6/1985 | DeWald | 166/332 |
| 4,553,598 | 11/1985 | Meek et al. | 166/264 |
| 4,610,308 | 9/1986 | Meek | 166/264 |
| 4,766,955 | 8/1988 | Petermann | 166/167 |

*Primary Examiner*—Jerome W. Massie, IV
*Assistant Examiner*—Terry Lee Melius
*Attorney, Agent, or Firm*—Michael E. Martin

[57] ABSTRACT

A wellbore fluid sampling apparatus includes an elongated barrel member having a chamber formed by a through flow passage opening from the bottom of the barrel member to a port in the barrel member. Spaced apart ball type valve closure members are connected to an actuating linkage comprising a rack and pinion mechanism connected to respective ones of the closure members. A cocking and retaining mechanism includes an actuating rod and a collet sleeve connected to the rack member and biased by a coil spring to move the rack member to simultaneously close both valves upon release of the collet sleeve from gripping engagement with the wall of the bore in a body member of the apparatus. In an alternate embodiment, the actuating member includes a part gripped by a stationary collet which may release the part upon movement of a sliding sleeve which is actuatable at will. The actuating member is connected to elongated cable traces which are operable to move the valves between open and closed positions. The ball valves include lateral ports for evacuating the closure member passages in the valve closed positions.

12 Claims, 7 Drawing Sheets

WELLBORE FLUID SAMPLING APPARATUS

BACKGROUND OF THE INVENTION

1. Field of the Invention

The present invention pertains to an apparatus for obtaining samples of wellbore fluids, such as crude oils, and which may be actuated in the wellbore to trap a fluid sample in a chamber through which the fluid has been allowed to flow.

2. Background

The development of crude oil reservoirs containing relatively viscous fluids and the development of deeper wellbores which operate at higher temperatures and pressures has dictated the need for improvements in wellbore fluid sampling apparatus which are able to withstand such relatively high pressures and temperatures. Moreover, there has also been a need for sampling apparatus capable of trapping a sample of the wellbore fluid without improper filling of the sample cavity in the apparatus and without contamination of the sample when it is retrieved from the apparatus.

To this end, certain improvements have been developed in wellbore fluid sampling apparatus such as described in U.S. Pat. No. 4,766955 issued on Aug. 30, 1988 in the name of Steven G. Petermann and assigned to the assignee of the present invention. The apparatus described in the application is exemplary of certain improvements in wellbore fluid sampling apparatus for collecting samples of relatively viscous oils under moderate pressure and temperature conditions. However, it has further been recognized that an apparatus which permits throughflow of the wellbore fluid prior to trapping a fluid sample in the apparatus provides certain advantages and the need to provide such an apparatus which is capable of operating at relatively high pressure and temperature conditions with reliable operation has resulted in the development of the present invention.

SUMMARY OF THE INVENTION

The present invention provides an improved wellbore fluid sampling apparatus for obtaining samples of relatively viscous wellbore fluids under relatively high pressure and temperature conditions in the wellbore. In accordance with an important aspect of the present invention, a wellbore fluid sampling apparatus is provided which permits flow of the wellbore fluids through the cavity in which the fluid sample is to be trapped prior to actuation of the apparatus to close off the cavity and retrieval of the apparatus from the wellbore.

In accordance with another aspect of the present invention, there is provided a wellbore fluid sampling apparatus which utilizes improved closure valves which minimize the prospect of contaminating the fluid sample upon retrieval of the apparatus from the wellbore, while minimizing the chance of leakage of the fluid sample from the apparatus and while providing an apparatus which is capable of withstanding high pressures and temperatures.

In accordance with still a further aspect of the present invention, a wellbore fluid sampling apparatus is provided which includes a unique actuating mechanism for operation of the closure members to trap a fluid sample in a chamber within the apparatus. The actuating mechanism is of a type which requires relatively low actuating forces, but which reliably maintains the apparatus in a cocked condition prior to actuation to close off the fluid sample chamber or cavity whereby unwanted triggering of the apparatus is minimized during insertion of the apparatus into the wellbore.

Those skilled in the art will further appreciate the above-described features and advantages of the present invention together with other superior aspects thereof upon reading the detailed description which follows in conjunction with the drawing.

BRIEF DESCRIPTION OF THE DRAWINGS

FIG. 5D.

DESCRIPTION OF PREFERRED EMBODIMENTS

Figure 1A:
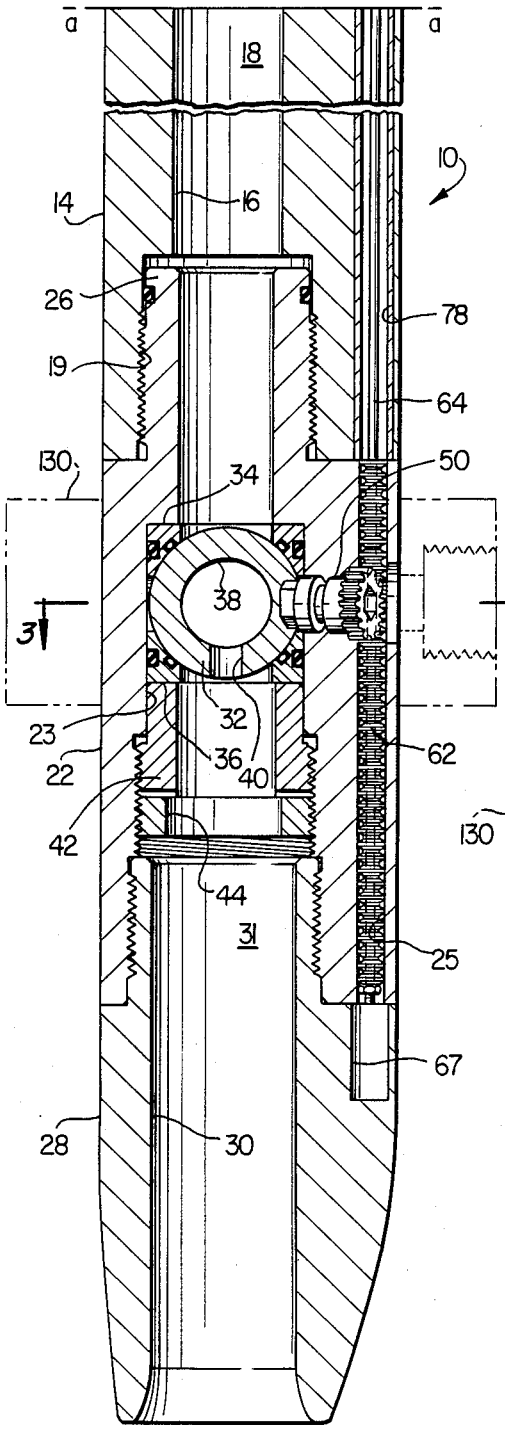
FIGS. 1A through 1D comprise a longitudinal central section view of one preferred embodiment of the wellbore fluid sampling apparatus of the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIGS. 1A through 1D, there is illustrated a central longitudinal section of a wellbore fluid sampling apparatus 10 which is adapted to be suspended in a wellbore at the end of a wireline cable or the like, not shown, and connected to means, not shown, for actuating the apparatus 10 to trap a sample of wellbore fluid in a cavity within the apparatus to be described in further detail herein. The actuating apparatus forms no part of the present invention; however, the sampler 10 is also preferably connected to an actuation indicator 12, FIG. 1D, of a type described in co-pending U.S. patent application Ser. No. 07/121,553 filed on Nov. 17, 1987 in the name of Jerry L. Haley and Dennis R. Wood and assigned to the assignee of the present invention. The above-mentioned actuation indicator 12 is preferably also connected to a tripping or actuating mechanism of a type commercially available and known as a driving clock. One such type of apparatus is manufactured by Leutert Instruments Inc., Houston, Tex. The apparatus 10 may be actuated by other types of actuators as will be appreciated by those skilled in the art.

Figure 1B:
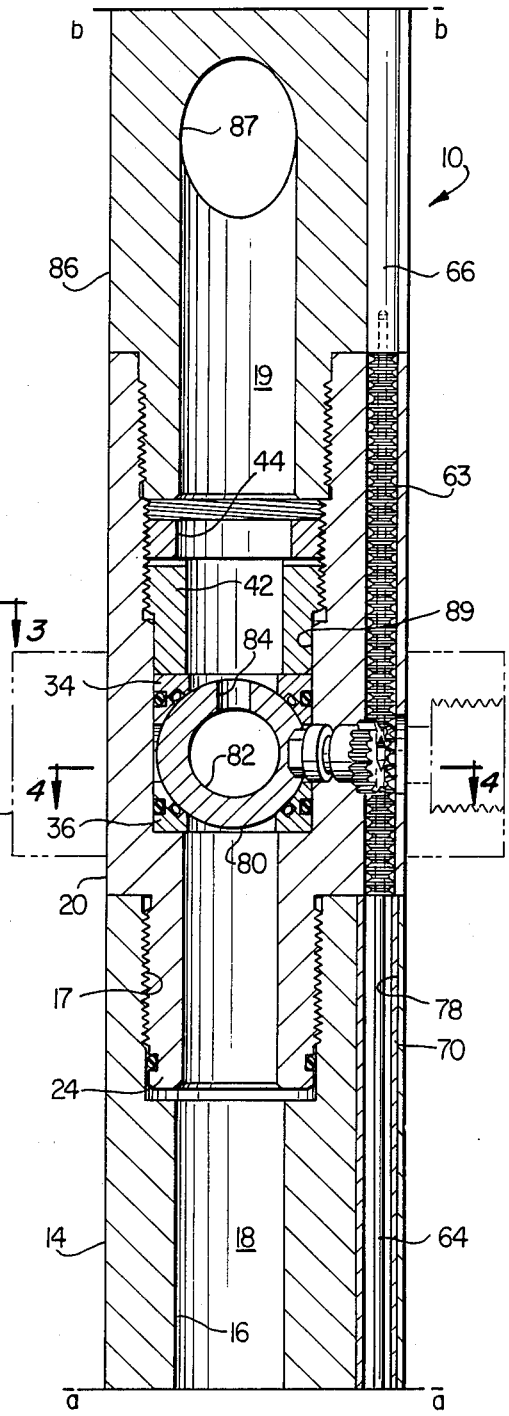

Referring primarily to FIGS. 1A and 1B, the apparatus 10 includes an elongated, generally cylindrical barrel member 14 which includes a longitudinal through bore 16 forming an internal cavity or chamber 18 for containing a sample of wellbore fluid. The barrel member 14 is provided with threaded portions 17 and 19 at its opposite ends for receiving separable barrel portions 20 and 22, respectively. The barrel portion 20 includes a threaded spigot portion 24 which is adapted to be threadedly coupled to the barrel 14 and the barrel portion 22 also includes a threaded spigot portion 26 for coupling to the barrel member 14.

Referring primarily to FIG. 1A, the barrel portion 22 is also coupled to a lower nose part 28 having a longitudinal bore 30 for receiving a fluid sample which may pass through the nose part 28, the barrel portion 22 and into the chamber 18 under certain operating conditions of the apparatus 10 to be described in further detail herein. For the sake of this discussion, the apparatus 10 is normally lowered into a wellbore, not shown, with the nose part 28 as the lowermost portion of the apparatus when it is in its working position and the opposite end of the apparatus 10 is the end which is connected to the actuation indicator mechanism 12.

Referring further to FIG. 1A, one end of the cavity or chamber 18 is operable to be closed by a ball type valve closure member 32 which is disposed in a cavity formed in the barrel portion 22 and supported between opposed generally cylindrical seat members 34 and 36. The closure member 32 includes a through bore 38 and a port 40 which intersects the bore 38 at right angles and, in the position shown in FIG. 1A, is open to a cavity 31 which opens to the lower end of the nose part 28 so that the bore 38 and the port 40 are exposed to the same environment as the cavity 31. The closure member 32 and the seats 34 and 36 are retained in a bore 23 formed in the barrel portion 22 by a tubular retainer 42 which is preferably threadedly engaged with the barrel portion 28 and is secured in place by a tubular locknut 44, also threadedly engaged with the barrel portion 22.

Figure 3:
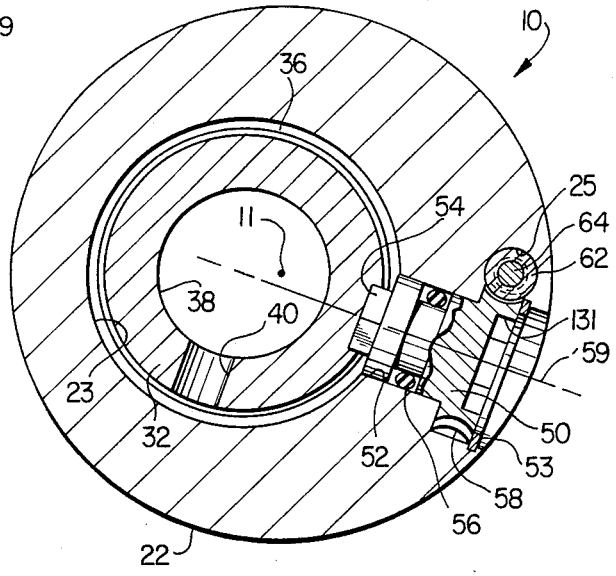
FIG. 3 is a section view taken generally along the line 3—3 of FIG. 1A.

Referring further to FIGS. 1A and 3, it will be noted that the bores forming the cavity or passage 31 and the bore 16 are formed in the barrel members 14 and 22 somewhat off center from the outer cylindrical shape of the barrel members to provide room for an actuating mechanism for actuating the closure member 32 and to also provide for a minimum wall thickness of the barrel sufficient to withstand the design pressure of the apparatus 10. The closure member 32 is adapted to be moved between the valve open position shown in FIG. 3 and the closed position shown in FIG. 1A by mechanism including a drive member 50 which is rotatably disposed in a bore 52 formed in the barrel portion 22. The drive member 50 includes a polygonal shaped drive tang 54 which is disposed in a cooperating recess formed in the closure member 32. The drive member 50 is provided with seal means comprising a suitable o-ring seal or the like 56 to prevent leakage of fluids into and out of the barrel cavities or chamber portions through the passage formed by the bore 52. The drive member 50 also includes a pinion 58 formed thereon and adapted for rotation about an axis 59 passing through the center of the closure member 32. The pinion 58 is engaged with a generally cylindrical gear rack member 62 disposed in a bore 25 formed in the barrel portion 22 and extending generally parallel to the longitudinal central axis 11 of the apparatus 10.

Figure 2A:
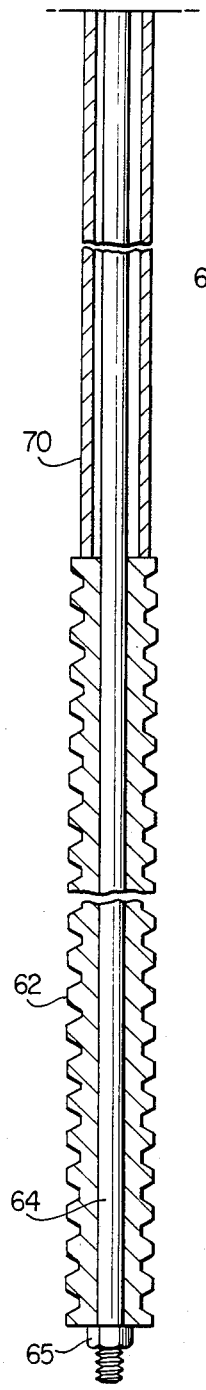
FIGS. 2A and 2B comprise a longitudinal central section view of the rack mechanism for the apparatus of FIGS. 1A and 1D.
Figure 2B:
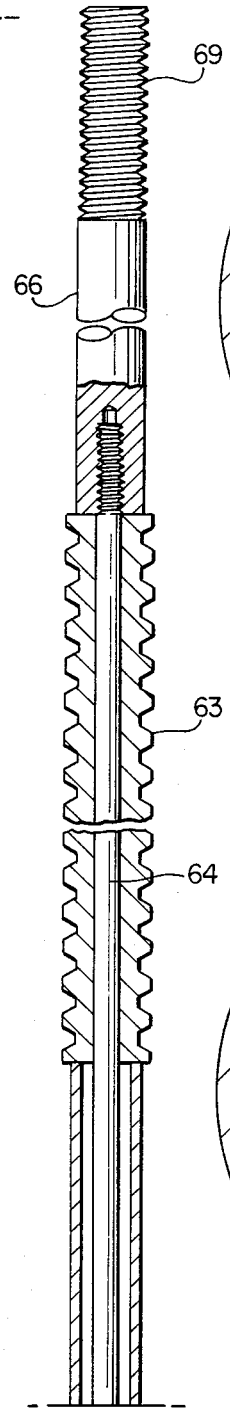

As shown in FIGS. 1A, 2A and 2B, the rack 62 comprises a generally tubular member which is sleeved over an elongated actuating rod 64 extending within cooperating bores formed in the barrel members 22, 14 and 20, see FIG. 1B also, and is threadedly connected to a continuing actuating rod member 66 as illustrated in FIG. 1B. A second rack member 63 is also secured in sleeved relationship over the rod 64 and is held in spaced relationship from the rack member 62 by a spacer sleeve 70 interposed therebetween and also in sleeved relationship over the rod 64. When the rod 64 is threadedly connected to the rod member 66, the racks 62 and 63 and the spacer sleeve 70 may be retained in assembly with the rod by a retaining nut 65, see FIG. 2A, disposed over the lower end thereof. A recess 67 is formed in the nose part 28, FIG. 1A, to permit movement of the actuating rod assembly above-described within the bore 25. As further shown in FIGS. 1A and 1B, the spacer sleeve 70 is slidably disposed in an elongated bore 78 formed in the barrel member 14 and aligned with the bore 25.

Figure 4:
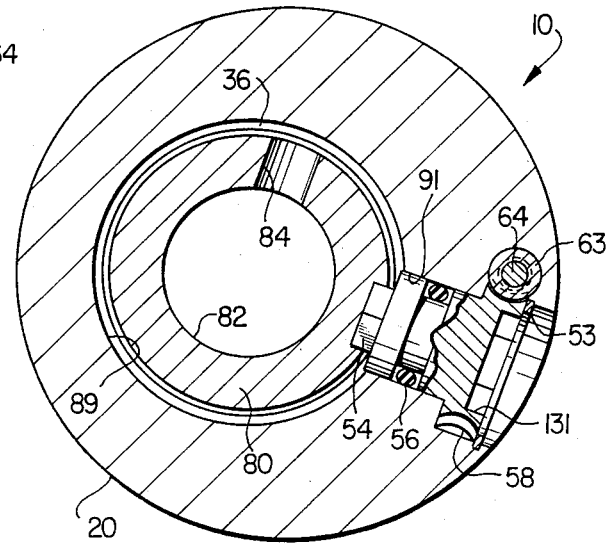
FIG. 4 is a section view taken generally along the line 4—4 of FIG. 1B.

Referring further to FIGS. 1B and 4, the chamber 18 is also adapted to be closed by a second closure member 80 similar to the closure member 32 and having a through bore 82 formed therein and a transverse port 84 intersecting the bore 82 and operable, in the position illustrated in FIG. 1B, to open into a cavity or passage 19 formed in part by the barrel member 20 and an upper head member 86. The passage 19 opens to the exterior of the head member 86 through a port 87 so that fluid may flow completely through the apparatus 10 by way of the cavities or chambers 31, 18 and 19 from the nose part 28 to the head member 86. This through flow of fluid is, of course, permitted when the closure members 32 and 80 are both in a position to align their respective through passages 38 and 82 with the bore 16 to permit such flow. The closure member 80 is also supported between opposed seat members 34 and 36 disposed in a bore 89 formed in the barrel member 20. Retainers 42 and 44 are operable to secure the seats 34 and 36 in the bore 89.

Referring further to FIGS. 1B and 4, the closure member 80 is also operably engaged with a second drive member 50 disposed in a bore 91 formed in the barrel portion 20 in a manner substantially like the arrangement illustrated for the closure member 32. A drive tang 54 is engaged with the closure member 80 for rotating same in response to movement of the rack member 63 which is meshed with pinion 58. The drive member 50 is suitably retained in the bore 91 by a retaining ring 53 in the same manner that the drive member 50 is retained in the bore 52.

Figure 1C:
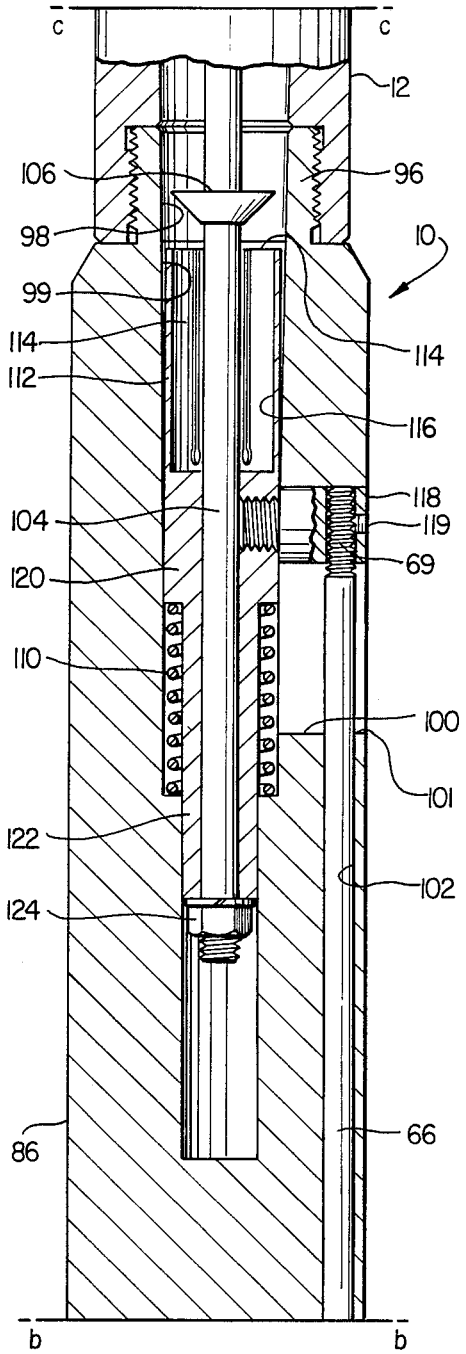
Figure 1D:
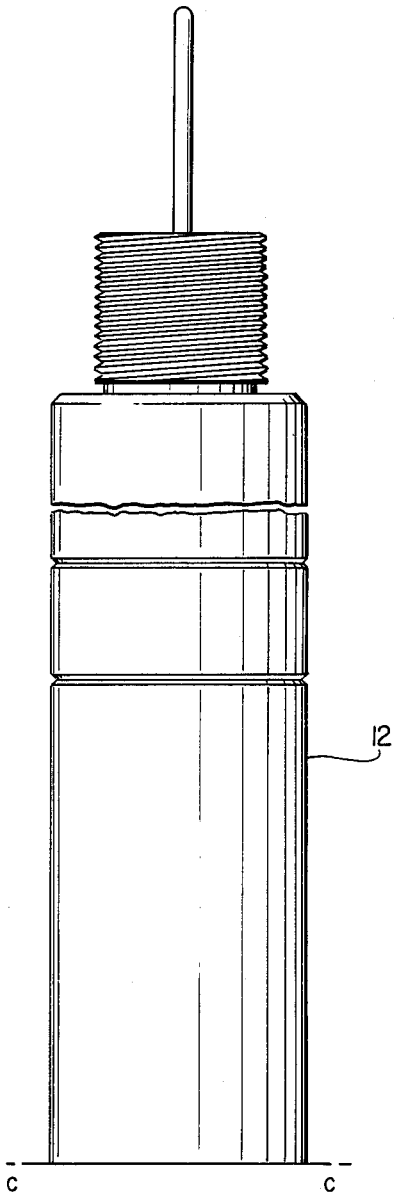

Referring to FIG. 1C, the head member 86 includes a spigot portion 96 at its upper end which is threadedly coupled to the actuation indicator assembly 12 and includes an axial bore 98 extending therewithin and having a tapered portion 99. An elongated slot 100 intersects the bore 98 and opens to the exterior of the head member 86. A bore 102 for journalling the rod 66 also opens to the slot 100.

The apparatus 10 includes a unique cocking and actuating mechanism for simultaneously closing the valve closure members 32 and 80 to trap a fluid sample in the chamber 18. The cocking and actuating mechanism includes an elongated rod 104 disposed in the bore 98 and including a somewhat conical shaped flange 106 formed thereon. The rod 104 is suitably connected at a point, not shown, to the actuation indicator 12 and the opposite end of the rod extends through a coil spring 110 also disposed in the bore 98. An elongated collet sleeve member 112 is slidably disposed in the bore 98 in relatively close fitting relationship thereto and includes plural collet fingers 114 also forming a slightly tapered bore 116 for receiving the flange 106. The collet 112 is connected to a radially projecting link 118 which is secured to the end 69 of rod 66 by a suitable set screw 119 or the like. The collet 112 is also provided with a body portion 120 which is engaged With the spring 110 and an elongated reduced diameter sleeve portion 122 extends in sleeved relationship over the rod and is prevented from removal from the rod by a retaining nut 124. The spring 110 exerts a biasing force on the collet 112 which is sufficient to move the collet and the actuating rod 66 to effect operation of the closure members 32 and 80 simultaneously to close off the chamber 18 from communication with the cavities 31 and 19.

The collet 112 is moved to the cocked position to compress the spring 110 and move the valve closure members 32 and 80 to an open, through flow position by movement of the rod 104 in a downward direction, viewing FIG. 1C. When the closure members 32 and 80 are moved to their valve open positions the collet 112 is stopped from further movement by engagement of the link 118 with the endwall 101 of the slot 100 which coincides with the open position of the valves. Further downward exertion of force on the rod 104, viewing FIG. 1C, causes the flange 106 to force the collet fingers 114 radially outwardly to grip the wall surface defining the tapered portion 99 of the bore 98 to lock the collet 112 in the cocked position against the urging of the spring 110. The rod 104 is suitably moved to the cocked position by the aforementioned actuating mechanism, including the actuation indicator 12, when the actuator is set before lowering the assembly of the actuator and the apparatus 10 into a wellbore.

Accordingly, when the apparatus 10 is prepared for obtaining a sample of wellbore fluid the collet 112 and the rod 104 are moved in a downward direction, viewing FIG. 1C, until the wedging action of the flange 106 causes the collet fingers to grip the wall of the tapered bore portion 99 to retain the closure members 32 and 80 in their open through flow positions. When the apparatus 10 is suitably located in the wellbore to allow the flow of wellbore fluid into the cavity or chamber 31, the chamber 18 and out of the apparatus through the cavity 19 and port 87 the sampler actuator, via the actuation indicator 12, may be suitably controlled to exert a moderate upward pulling effort on the rod 104 to move the rod and flange 106 at will out of forcible engagement with the collet fingers 114 allowing the collet fingers to relax and move radially inwardly to release gripping engagement of the bore wall. The spring 110 moves the collet sleeve 112 upwardly thus moving the rod assembly 64, 66 to simultaneously close the closure members 32 and 80 trapping a fluid sample in the chamber 18. Thanks to the arrangement of the cocking and actuating mechanism formed by the rod 104, the collet 112 and the spring 110 only a moderate actuating force is required to be exerted on the rod 104 which, upon movement to release forcible engagement with the collet fingers 114, allows the collet to move under the urging of the spring 110. Still further, the arrangement of the collet 112 and the actuating rod 104 relieves the actuating rod 104 of the requirement to transfer a substantial actuating force to the actuation indicator 12 during the cocked condition of the apparatus since most of the force of the spring 110 urging the collet 112 upwardly is counteracted by frictional engagement of the fingers 114 with the wall of the bore portion 99. When the closure members 32 and 80 move to their closed positions the ports 40 and 84 are in communication with the passages or cavities 31 and 19, respectively, thereby relieving fluid pressure in the passages 38 and 82 when the apparatus 10 is retrieved from a wellbore.

When a sample of fluid is trapped in the chamber 18 and the apparatus 10 is retrieved from a wellbore, the nose part 28 is threadedly uncoupled from the barrel portion 22 and replaced by an adapter, not shown, including suitable porting for collecting the fluid sample trapped in the chamber 18. The head member 86 is also disassembled from the barrel assembly comprising the members 14, 20 and 22 by first disconnecting the actuating rod 66 from the link 118 and then threadedly uncoupling the rod 66 from the rod member 64. This action then permits uncoupling of the head member 86 from the barrel member 20 and placement of a suitable adapter, not shown, in coupled relationship with the barrel member for purging unwanted fluid out of the passage 19 and the closure member passages formed by the passage 82 and the port 84 in preparation for retrieving the fluid sample disposed in the chamber 18.

As shown in FIGS. 1A and 1B, by way of example, suitable adapter sleeves 130 may be placed over the barrel members 20 and 22 and secured in position aligned with the bores 50 and 91, respectively, to prevent unwanted ejection of the drive members 50 from the respective bores. A suitable wrench may be inserted in a polygonal socket 131 of the respective drive members 50 to rotate the drive members and the closure members associated therewith to place the chamber 18 in flow communication with suitable means, not shown, for receiving the fluid sample from the chamber.

Referring now to FIGS. 5A through 5E, an alternate embodiment of the apparatus of the present invention is illustrated and generally designated by the numeral 210. The apparatus 210 includes an elongated barrel member 212, FIGS. 5A and 5B, having an internal bore 213 forming a chamber 214 for holding a sample of wellbore fluid to be retrieved from a wellbore utilizing generally the procedure and arrangement described in conjunction with the embodiment in FIGS. 1A through 4. The barrel member 212 is also adapted to support rotatable ball type valve closure members 218 and 220 spaced apart in the barrel member and supported between cylindrical seat members 222 and 224. The respective sets of seat members 222 and 224 are supported by respective retainer members 226 and the assembly of the retainer members, seat members and the ball closure members are held in assembly with the barrel member 212 by opposed respective barrel extension parts 228 and 230. A removable tubular nose piece 232 is secured to the extension part 228. A second barrel extension part 236 is threadedly coupled to the part 230 and includes a through passage 238 formed therein which is in communication with the exterior of the apparatus 210 by way of a port 239.

Figure 5A:
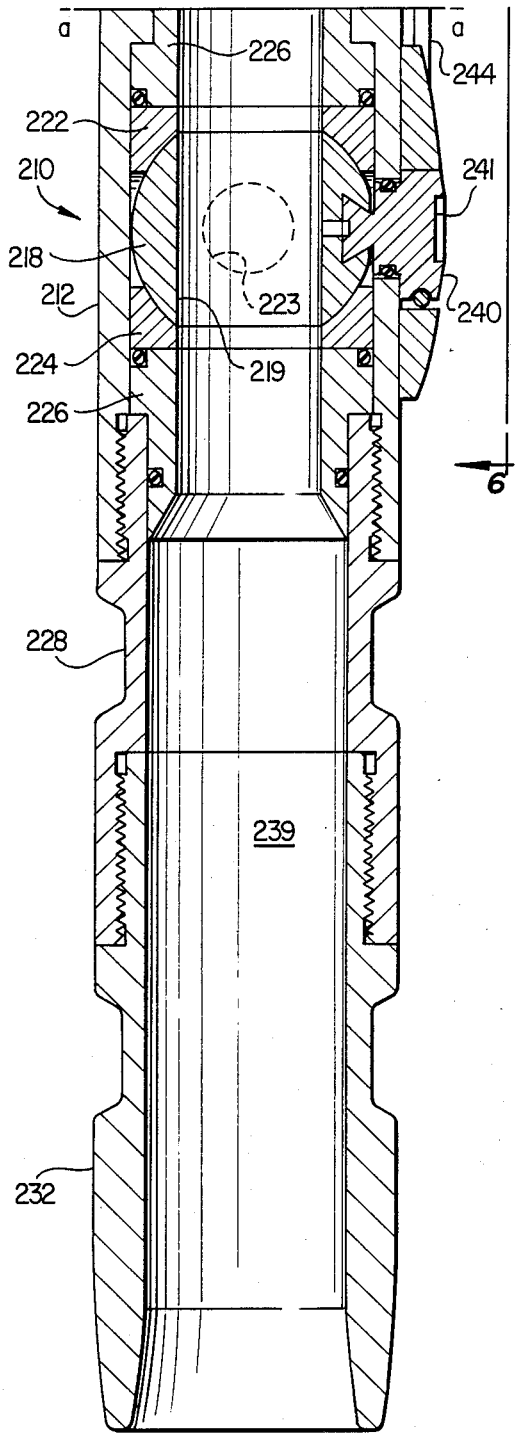
FIGS. 5A through 5E comprise a longitudinal central section view of an alternate embodiment of the present invention.
Figure 5B:
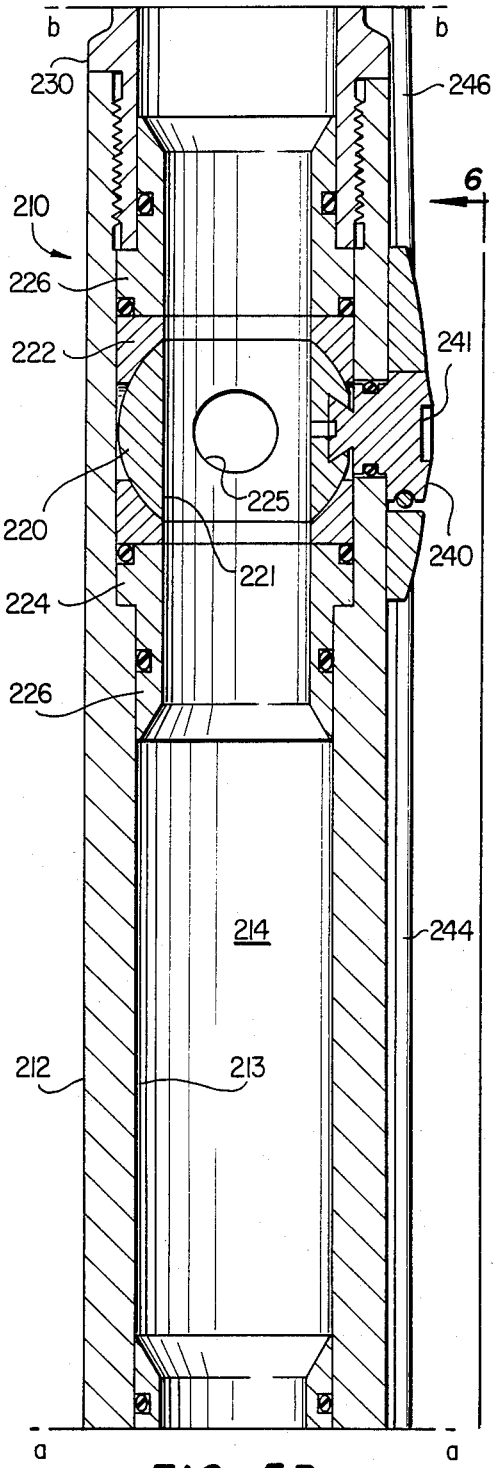
Figure 5C:
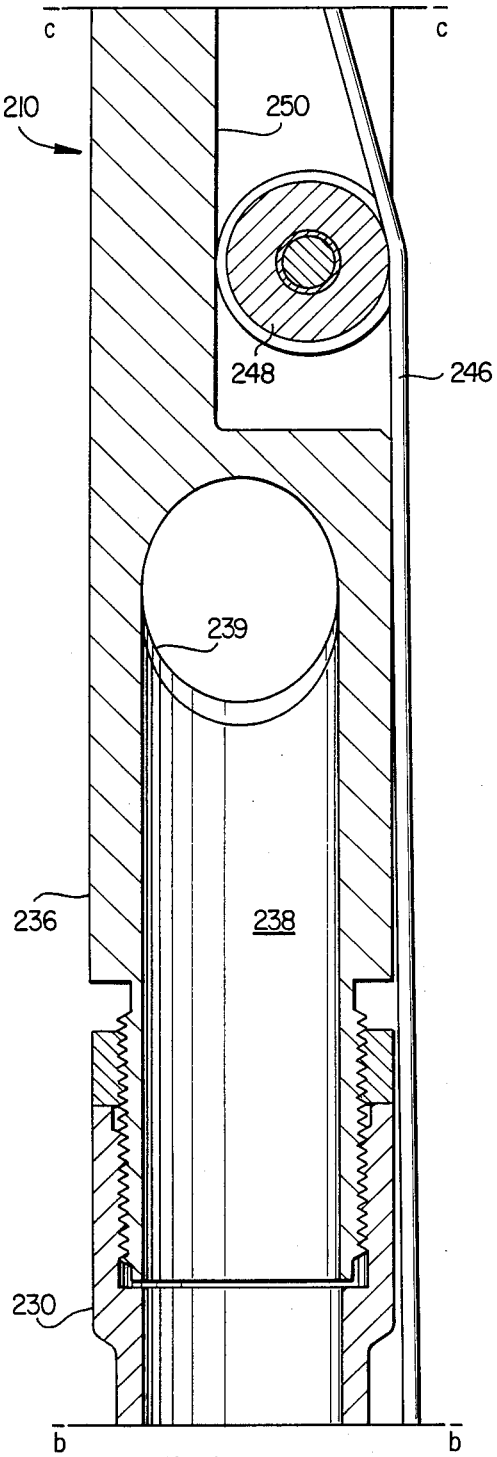
Figure 6:
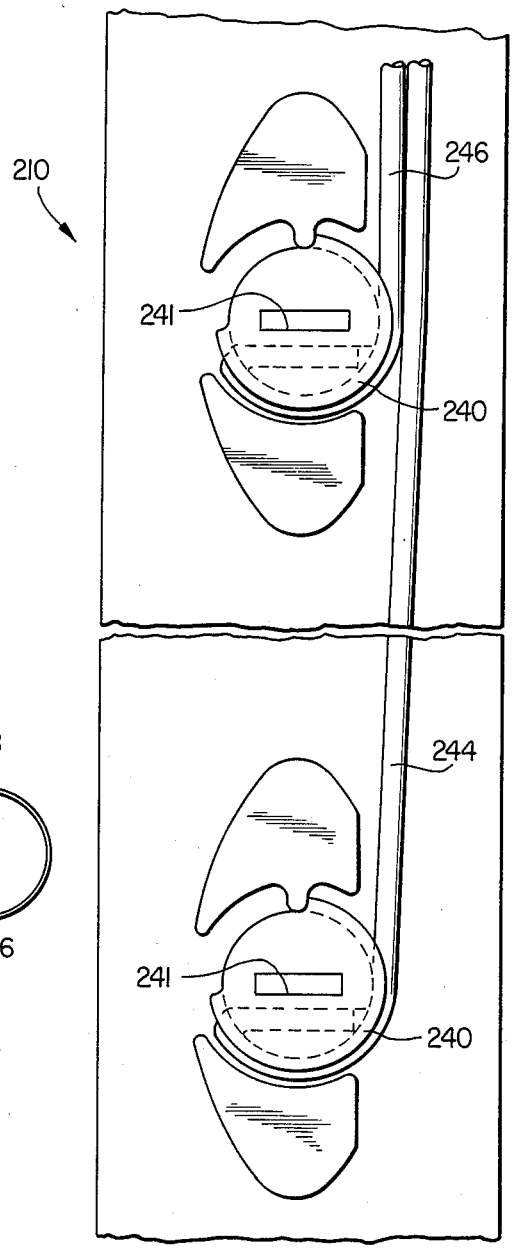
FIG. 6 is a detail view taken generally from the line 6—6 of 5A and 5B.
Figure 7:
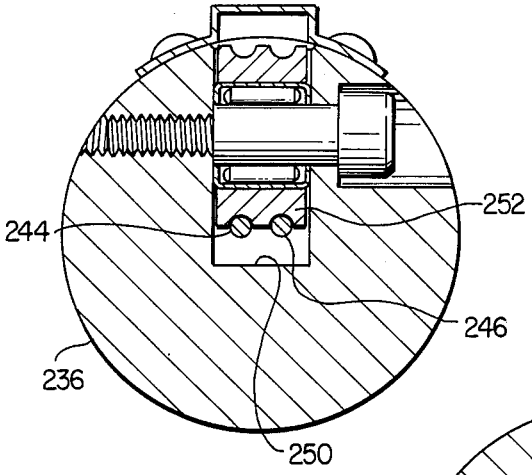
FIG. 7 is a section view taken generally along line 7—7 of FIG. 5D.

Each of the closure members 218 and 220 is provided with a drive member 240 connected thereto and including a head portion 242 disposed on the exterior of the barrel 212. The respective drive members 240 are connected to elongated cable traces 244 and 246, as illustrated in FIG. 6, which are trained along the exterior of the apparatus 210 and over a guide sheave 248 disposed in a recess 250 formed in the extension part 236, FIG. 5C. In response to tension applied to the respective cables 244 and 246, simultaneously, the closure members 218 and 220 are moved from an open through flow position as illustrated in FIGS. 5A and 5B to the closed position illustrated in FIG. 6.

Figure 5D:
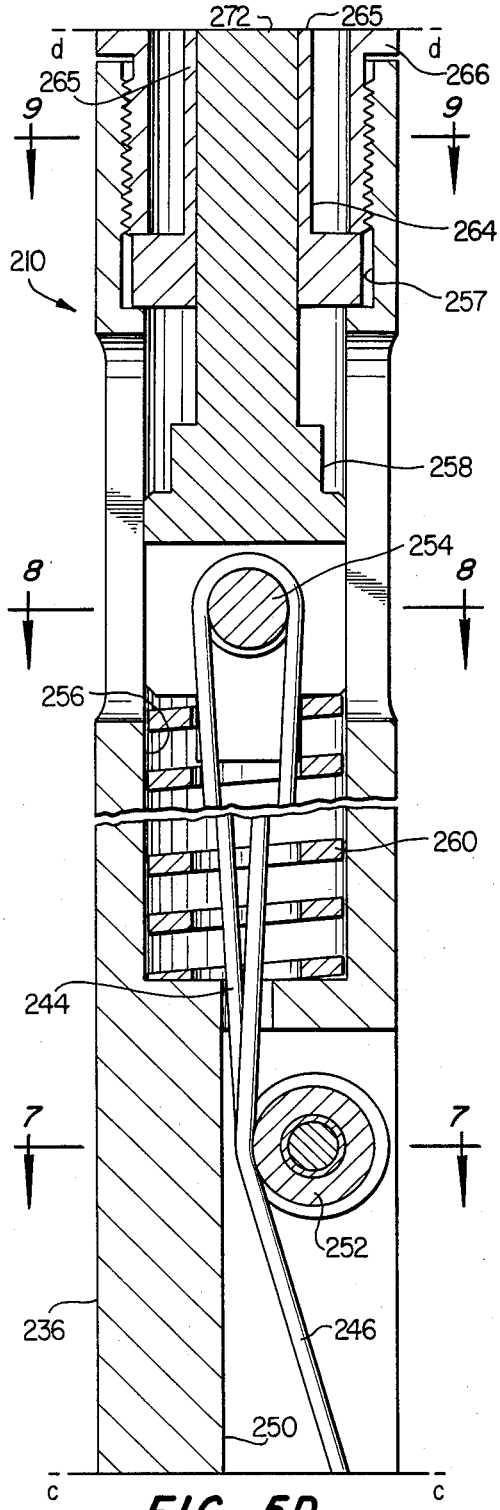
Figure 8:
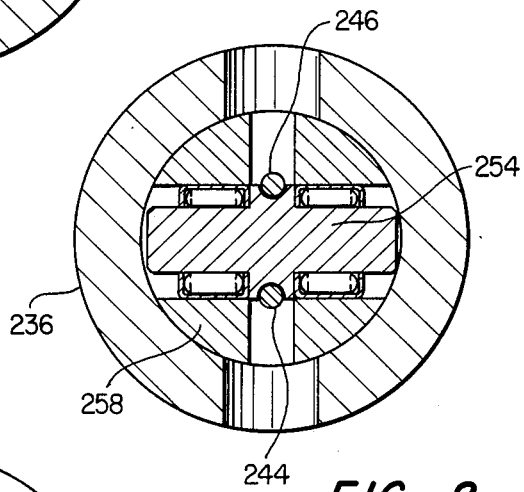
FIG. 8 is a section view taken along line 8—8 of FIG. 5D.
Figure 9:
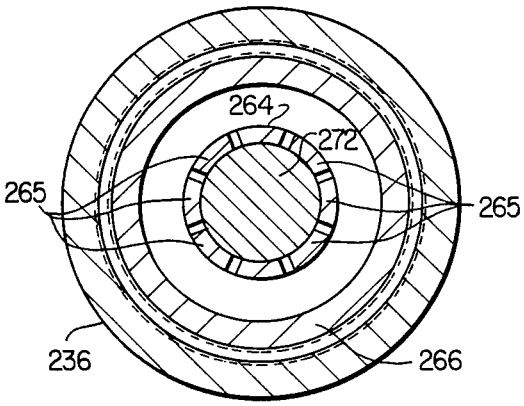
FIG. 9 is a section view taken along line 9—9 of FIG. 5D.

The cable traces 244 and 246 are also trained over a guide sheave 252, FIG. 5D, rotatably disposed in the recess 250 and a third guide sheave 254 disposed in an elongated bore 256 formed in the member 236. As illustrated in FIGS. 5D and 8, the sheave 254 is supported on a support member 258 slidably disposed in the bore 256 and engaged with a coil spring 260 also disposed in the bore, as illustrated in FIG. 5D. Accordingly, in response to movement of the support member 258 in an upward direction, viewing FIGS. 5A and 5D, the cable traces 244 and 246 are operable to rotate the ball closure members 218 and 220 from an open position wherein the chamber 214 is in communication with a wellbore to a closed position to trap a sample quantity of wellbore fluid in the chamber 214. In their respective closed positions each of the closure members 218 and 220 are disposed such that their respective flow passages 219 and 221 are in communication with the passages 239 and 238 by way of respective ports 223 and 225.

Figure 5E:
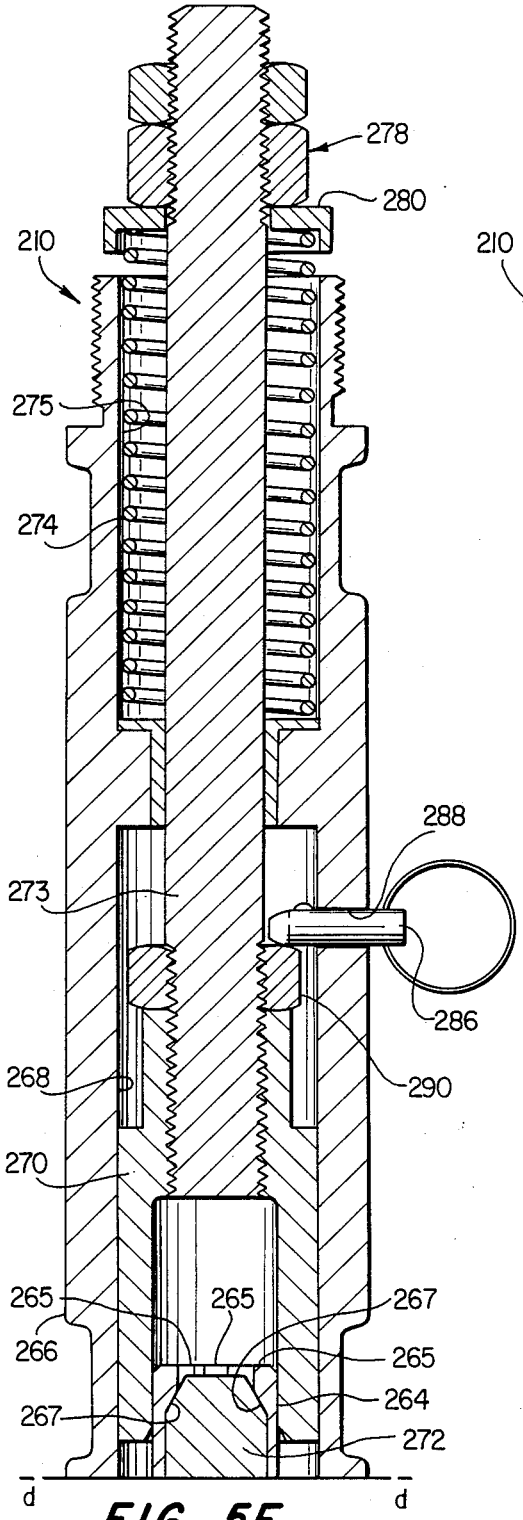

Referring further to FIGS. 5D and 5E, the support member 258 is operable to be held in a cocked position against the urging of the spring 260 by a mechanism including a collet 264 which is secured in an enlarged diameter portion 257 of the bore 256 and retained fixed with respect to the member 236 by a head member 266 threadedly coupled to the member 236. The head member 266 includes a bore 268 formed therein and in which is slidably disposed a retaining sleeve 270 which is operable to be disposed in sleeved relationship over the collet 264 to prevent opposed collet fingers 265 from deflecting radially outwardly to release retaining engagement with a reduced diameter distal end part 272 formed integral with the support member 258.

The retaining sleeve 270 is secured to an elongated rod member 273, FIG. 5E, extending from the upper end of the head member 266 and passing through a coil spring 274 retained in a bore 275 also formed in the head member. A retainer lock nut assembly 278 is threadedly secured to the distal end of the rod member 273 and is contiguous with a removable flange member 280 engaged with the spring 274. The rod member 273 is adapted to be engaged with a suitable release member, not shown, of an actuator similar to the types above-described and commercially available. A removable retaining pin 286 extends through a transverse bore 288 in the head member 266 for engagement with a locknut 290 secured to the rod 273 and engaged with the sleeve 270.

In the operation of the apparatus 210, the apparatus is prepared to collect a sample of wellbore fluid by moving the support member 258 to the position shown in FIG. 5D and moving the closure members 218 and 220 to their respective valve open positions so that a through flow passage is formed by the chamber 214 and the passage portions 238 and 239 to permit flow of wellbore fluid through the apparatus 210. The support member 258 is retained in the position illustrated against the bias of the spring 260 by moving the sleeve member 270 in sleeved relationship over the collet fingers 265 so that they are radially forced into engagement with the end part 272 and axial movement of the member 258 upward viewing FIGS. 5D and 5E, is prevented by the surfaces 267, FIG. 5E, on the ends of the collet fingers which engage the end part 272. Triggering mechanism in the aforementioned actuator is engageable with the rod 273 to hold it in the position shown against the bias of spring 274. The retaining pin 286 may be used during routine handling of the apparatus before insertion into the wellbore to minimize the chance of premature tripping of the closure members. The retaining pin 286 is removed once the apparatus is in final preparation for insertion into the wellbore.

When the apparatus 210 has been prepared for insertion into the wellbore, it is lowered to the desired position which assures that a sample of fluid completely fills the chamber 214 and the actuator is tripped to allow the rod 274 to move upward, viewing FIG. 5E, to move the sleeve 270 out of engagement with the collet fingers 265 whereupon the urging of spring 260 forces the support member 258 to radially spread the collet fingers 265 outwardly and allow the support member to move upward also so that tension in the cable traces 244 and 246 will effect simultaneous closing of the valve closure members 218 and 220.

When the fluid sample is trapped in the chamber 214 and the valve closure members are in their respective closed positions, the apparatus 210 is retrieved from the wellbore, the extension part 232 is removed from the barrel assembly and replaced by a suitable adapter for receiving the fluid sample and the support member 258 is moved to a position to allow slack in the cable so that the valve closure members may be moved from closed to open positions. Each of the drive members 240 may be provided with a suitable slot 241 for engagement of a driving tool to manually rotate the closure members during the sample transfer operation.

Those skilled in the art will appreciate the above-described features and advantages of the respective embodiments of a wellbore fluid sampling apparatus in accordance with the present invention. The overall construction and operation of the respective apparatus 10 and 210 is believed to be clear from the foregoing description. Conventional engineering materials for downhole wellbore tools may be utilized in manufacturing the components of the apparatus 10 and 210. Although preferred embodiments of the invention have been described in detail herein, those skilled in the art will recognize that various substitutions and modifications may be made to the embodiments shown and described without departing from the scope and spirit of the invention as recited in the appended claims.

What is claimed is:

1. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed positions to trap a sample of fluid in said chamber; and means for moving said closure members between open and closed positions to trap a sample of wellbore fluid in said chamber comprising an actuator member operable connected to said closure members, means for urging said actuator member in a direction to move said closure members from an open position to a closed position, means for retaining said actuator member in a position corresponding to an open position of said closure members, respectively, a member engaged with said means for retaining and movable at will to effect operation of said actuator member and means interconnecting said actuator member and said closure members, respectively, and operable to move said closure members to the closed position in response to said operation of said actuator member.

2. The apparatus set forth in claim 1 wherein:

said means for urging said actuator member comprises spring means.

3. The apparatus set forth in claim 1 wherein:

said actuator member includes and elongated part and said means for retaining includes a collet member engageable with said part and a movable sleeve adapted to be slidably disposed over said collet member to cause said collet member to engage said part to prevent movement of said actuator member to close said closure members, and said member movable at will is connected to said sleeve for displacing said sleeve relative to said collet member whereby said means for urging is operable to move said actuator member relative to said collet member to effect closure of said closure members, respectively.

4. The apparatus set forth in claim 1 wherein:

said means for retaining includes a collet including a plurality of collet fingers movable to forcibly engage a bore wall of a bore formed in said barrel member and said member movable at will includes a flange portion for engaging said collet fingers and urging said collet fingers into forcible engagement with said bore wall, said member movable at will being movable in a direction to release said forcible engagement of said collet fingers with said bore wall whereby said means for urging is operable to move said actuator member to effect closure of said closure members.

5. The apparatus set forth in claim 4 wherein:

said borewall is tapered axially outward in the direction of movement of said member movable at will to release said collet fingers.

6. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed portions to trap a sample of fluid in said chamber, said closure members each including a through flow passage formed therein and port means intersecting said through flow passages, respectively, and positioned such that in a closed position of said closure members, respectively, to trap a sample of wellbore fluid in said chamber said through flow passages are in communication with the exterior of said apparatus through said port means, respectively; and means for moving said closure members between open and closed positions to trap a sample of wellbore fluid in said chamber including an actuator member, means for retaining said actuator member in a position corresponding to an open position of said closure members, respectively, a member movable at will and means responsive to said member movable at will to cause said actuator member to effect movement of said closure members to the closed position.

7. The apparatus set forth in claim 6, wherein:

said means for moving said closure members includes an elongated rod connected to said actuator member, respective drive members operably connected to each of said closure members, said drive members each including a pinion connected thereto and gear rack means meshed with respective ones of said pinions and operably connected to said rod, said gear rack means being movable with said actuating rod to simultaneously move said closure members between open and closed positions.

8. The apparatus set forth in claim 6 wherein:

said closure members each include a drive member and said means for moving said closure members includes elongated cable means operably connected to said actuator member and to respective ones of said drive members and responsive to movement of said actuator member to move said closure members between open and closed positions.

9. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed positions to trap a sample of fluid in said chamber; and actuating means for moving said closure members from open to closed positions to trap a sample of wellbore fluid in said chamber, said actuating means including respective drive members operably connected to each of said closure members, said drive members each including a pinion connected thereto, gear rack means meshed with respective ones of said pinions, an elongated rod connected to said gear rack means, an actuator member connected to said rod and comprising a collet including a plurality of collet fingers movable to forcibly engage a bore wall of a bore formed in said barrel member, a member movable at will including a flange portion for engaging said collet fingers and urging said collet fingers into forcible engagement with said bore wall, said member movable at will being movable to effect release of said forcible engagement of said collet fingers with said bore wall and means operable to move said actuator member to effect closure of said closure members upon movement of said member movable at will to effect release of said forcible engagement of said collet fingers with said bore wall.

10. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed positions to trap a sample of fluid in said chamber said closure members comprise generally spherical ball type closure members, each including a through flow passage formed therein and port means intersecting said through flow passage and positioned such that in a closed position of said closure members, respectively, to trap a sample of wellbore fluid in said chamber said through flow passages are in communication with the exterior of said apparatus through said port means, respectively; and means for moving said closure members between open and closed positions to trap a sample of wellbore fluid in said chamber.

11. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed positions to trap a sample of fluid in said chamber; and means for moving said closure members between open and closed positions to trap a sample of wellbore fluid in said chamber comprising an actuator member operably connected to said closure members, means for urging said actuator member in a direction to move said closure members from an open position to a closed position, means for retaining said actuator member in a position corresponding to an open position of said closure members, respectively, a member engaged with said means for retaining and movable at will to effect operation of said actuator member and means interconnecting said actuator member and said closure members, respectively, including an elongated rod connected to said actuator member, respective drive members operably connected to each of said closure members, said drive members each including a pinion connected thereto and gear rack means meshed with respective ones of said pinions and operably connected to said rod, said gear rack means being movable with said rod to simultaneously move said closure members between open and closed positions.

12. A wellbore fluid sampling apparatus comprising:

an elongated barrel member including a passage extending therein and defining a fluid sample chamber;

spaced apart valve closure members supported on said barrel member and operable, respectively, to be moved from open positions permitting flow of fluid into and through said chamber to closed positions to trap a sample of fluid in said chamber, said closure members each including a drive member;

means for moving said closure members between open and closed positions to trap a sample of wellbore fluid in said chamber comprising an actuator member operably connected to said closure members, means for urging said actuator member in a direction to move said closure members from an open position to a closed position, means for retaining said actuator member in a position corresponding to an open position of said closure members, respectively, a member engaged with said means for retaining and movable at will to effect operation of said actuator member and means interconnecting said actuator member and said closure members, respectively, including elongated cable means operably connected to said actuator member and to respective ones of said drive members and responsive to movement of said actuator member under the urging of said means for urging to simultaneously move said closure members between open and closed positions.

* * * * *